US005678807A

United States Patent [19]

Cooper

[11] Patent Number: 5,678,807

[45] Date of Patent: Oct. 21, 1997

[54] ROTARY DEGASSER

[76] Inventor: Paul V. Cooper, 11247 Lake Forest Dr., Chesterland, Ohio 44026

[21] Appl. No.: 489,962

[22] Filed: Jun. 13, 1995

[51] Int. Cl.[6] ..... C21C 7/00

[52] U.S. Cl. ..... 266/216; 266/233; 266/235

[58] Field of Search ..... 266/216, 217, 266/233, 235

[56] References Cited

U.S. PATENT DOCUMENTS

| | | | |
|---|---|---|---|
| 3,227,547 | 1/1966 | Szekely | 266/235 |
| 3,743,263 | 7/1973 | Szekely | 266/235 |
| 3,785,632 | 1/1974 | Kraemer et al. | 266/235 |
| 3,839,019 | 10/1974 | Bruno et al. | 266/235 |
| 3,871,872 | 3/1975 | Downing et al. | 75/708 |
| 3,972,709 | 8/1976 | Chia et al. | 266/216 |
| 4,018,598 | 4/1977 | Markus | 75/708 |
| 4,052,199 | 10/1977 | Mangalick | 75/708 |
| 4,372,541 | 2/1983 | Bocourt et al. | 266/220 |
| 4,392,888 | 7/1983 | Eckert et al. | 75/708 |
| 4,556,419 | 12/1985 | Otsuka et al. | 266/235 |
| 4,611,790 | 9/1986 | Otsuka et al. | 266/235 |
| 4,634,105 | 1/1987 | Withers et al. | 266/217 |
| 4,717,540 | 1/1988 | McRae et al. | 420/513 |
| 4,743,428 | 5/1988 | McRae et al. | 420/590 |
| 4,802,656 | 2/1989 | Hudault et al. | 266/225 |
| 4,804,168 | 2/1989 | Otsuka et al. | 75/708 |
| 4,844,425 | 7/1989 | Piras et al. | 266/215 |
| 4,931,091 | 6/1990 | Waite et al. | 75/680 |
| 5,203,681 | 4/1993 | Cooper | 417/424.1 |
| 5,308,045 | 5/1994 | Cooper | 266/235 |
| 5,364,078 | 11/1994 | Pelton | 266/235 |

*Primary Examiner*—Scott Kastler

*Attorney, Agent, or Firm*—Jones, Day, Reavis & Pogue

[57] ABSTRACT

A rotary degasser for removing impurities from molten metal is disclosed that includes a degasser shaft, an impeller block and a coupling. The shaft is preferably hollow to allow for the passage of gas therethrough. The impeller block is connected to the degasser shaft, is formed of heat resistant material and has at least one metal-transfer recess, which displaces molten metal when the block is rotated. The block preferably includes at least one gas inlet in communication with the hollow portion of the degasser shaft and a gas-release opening formed in each metal-transfer recess. Each gas-release opening communicates with one of the gas inlets. The coupling connects the degasser shaft to a drive shaft and is formed of two or more coupling members. The coupling has a closed position in which it retains the degasser shaft and an open position in which it does not retain the degasser shaft. The coupling also includes a retainer that is connected to one of the coupling members and an adjustment device connected to the retainer. The adjustment device has a first position in which the coupling is retained in its closed position and a second position in which the coupling is not retained in its closed position and can be moved to its open position.

19 Claims, 7 Drawing Sheets

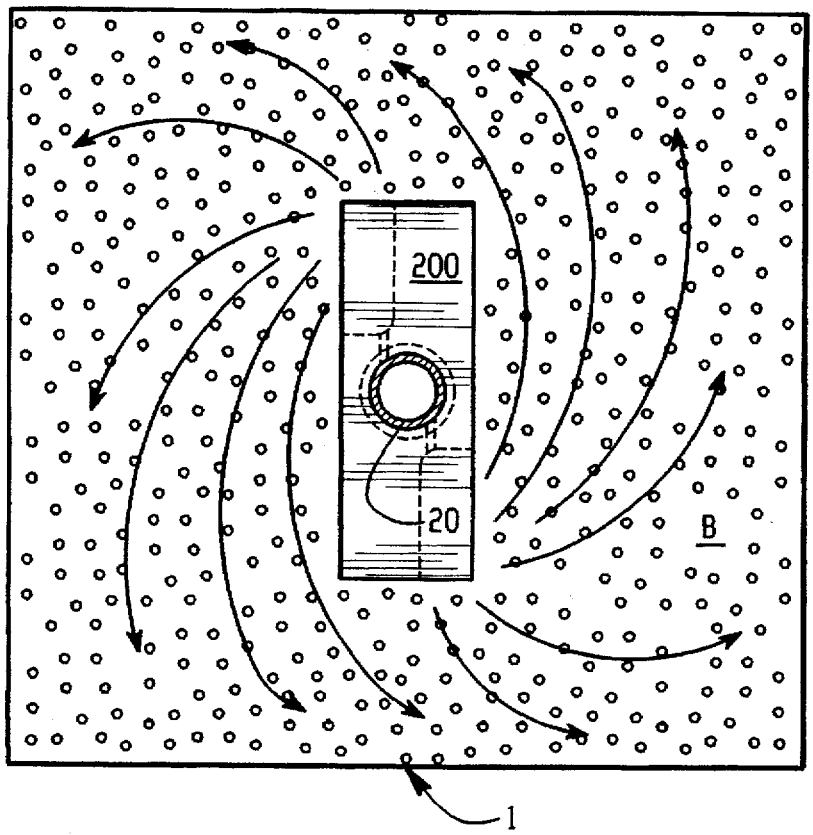
Fig. 9A
Fig. 9B
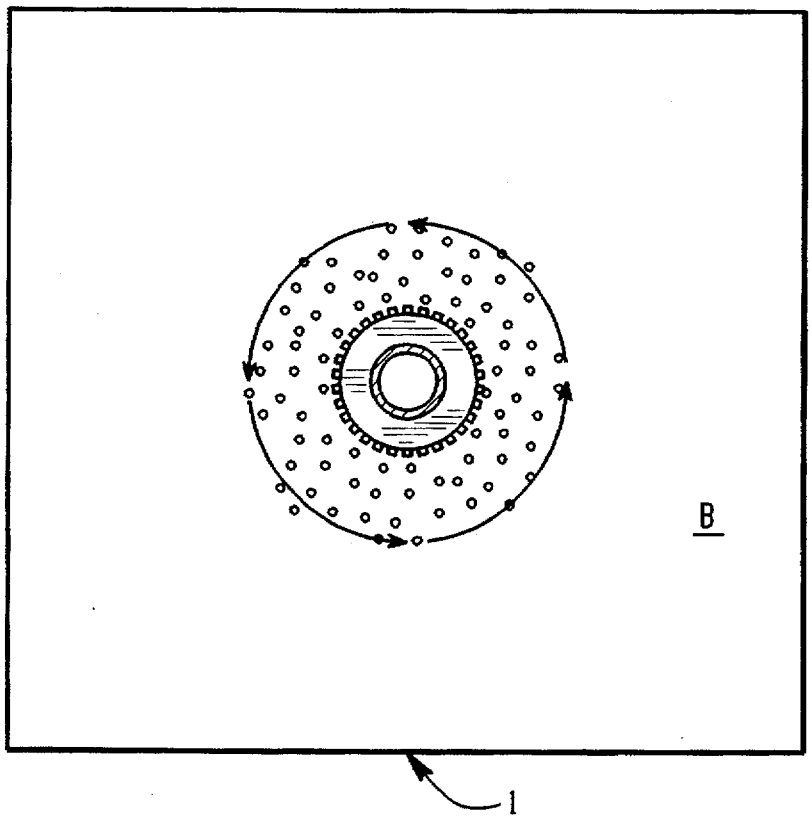

ROTARY DEGASSER

FIELD OF THE INVENTION

This invention relates to a device for introducing gas into molten metal and, more particularly, to a device for introducing inert gas into molten metal for the purpose of removing impurities such as dissolved hydrogen gas.

BACKGROUND OF THE INVENTION

Dissolved gases, particularly hydrogen, become dissolved in molten aluminum during processing in a furnace. Removing dissolved gas is usually the last step prior to casting aluminum into a product and, if the dissolved gas is not removed, the resulting aluminum products will contain entrapped gas forming small cavities or pockets. Finished products formed with these small gas pockets are undesirable because they may have uneven surfaces, contain holes or lack structural integrity.

The present device introduces inert gas, such as nitrogen or argon, into a molten aluminum bath wherein the inert gas removes the dissolved hydrogen from the molten aluminum bath. This process is known by those skilled in the art as degassing. The term bath as used herein refers to the molten metal retained within either the tank of the reverbatory furnace or a tank downstream of the furnace. Degassing is usually performed in a relatively stagnant or slow-moving bath of molten aluminum.

In addition to removing dissolved hydrogen gas, degassing also has the result of removing some solid impurities, such as oxides and salts, sodium fluoride, aluminum fluoride and other fluorides, which may be present in the molten metal suspension in the presence of dissolved hydrogen. Additionally, the present device can be used to introduce chlorine gas into the molten aluminum bath thereby removing magnesium. The chlorine and magnesium bond to form magnesium chloride which separates from the molten aluminum. Those skilled in the art refer to this process as demagging.

Several devices for introducing gas into molten metal for the purpose of removing impurities are known. These devices can be divided into two general categories. The first category includes devices that effuse gas through a wand, or other gas-release means into the molten metal bath. A device of this type is shown in U.S. Pat. No. 4,844,425 to Piras et al., which discloses an apparatus for the on-line treatment of degassing and filtration of aluminum and its alloys. The apparatus includes an insulated container body having a removable lid and heating means for heating the metal. The container body is partitioned into two chambers and has a gas-injection means positioned in the first chamber. Molten metal enters through an inlet port into one of the chambers and, as the molten metal enters the first chamber, gas is injected through the gas-injection means in a counter-current relationship to the entering metal stream. At the bottom of the second chamber a substantially horizontal plate of porous material, such as ceramic or graphite, is provided. The molten metal coming from the first chamber passes through the porous plate into the second chamber and is discharged through a discharge port.

The second category includes devices that inject or release gas through one or more orifices into the molten metal bath, and that also include a propeller, impeller or other type of blade device to shear or break the gas into small bubbles. The blades mechanically chop the gas stream as it exits the orifice(s) and disperses the gas bubbles into the molten metal. A device such as this is shown in U.S. Pat. No. 4,634,105 to Withers et al., which discloses a rotary device for dispersing gas, such as argon, into molten metal. The device has a hollow shaft and a hollow rotor affixed to the shaft. The rotor has an annular aperture adjacent the shaft and includes at least two vanes that divide the hollow interior of the rotor into compartments. Molten metal enters the rotor through the annular aperture and enters the compartments. Gas is introduced into each compartment through a gas-release aperture where it is dispersed into the aluminum.

Another device that mechanically chops the gas into small bubbles and mixes the bubbles with the molten metal is shown in U.S. Pat. No. 4,611,790 to Otsuka et al. Otsuka et al. discloses a device having a hollow shaft with a rotor fixed to the end of the shaft. The rotor contains radial grooves. In operation, the rotor rotates and gas is released from a discharge outlet at the bottom of the rotor. The gas rises into the radial grooves where it is mechanically chopped into small bubbles and mixed with the metal.

Another device that mechanically chops the gas is shown in U.S. Pat. No. 4,898,367 to Cooper entitled "Dispersing Gas Into Molten Metal." This reference discloses a device having a hollow shaft rigidly connected to a square impeller. As the shaft and impeller rotate, large gas bubbles are released through a hole in the bottom of the impeller and rise upward. The bubbles are mechanically chopped into smaller bubbles by the corners of the impeller and mixed into the molten metal.

There are several problems associated with the prior art devices, including the fact that they are relatively inefficient. Inefficient in this sense means that the known devices do not efficiently disperse gas into the molten metal bath. Therefore, the impurities in the molten metal are not adequately removed and/or an inordinate amount of gas is used to remove the impurities from the metal. The inefficiency is caused in part by the inability of the devices to thoroughly mix the gas throughout the molten metal bath. As stated above, the molten metal bath is relatively stagnant in the tank. Once the gas is released into the bath it tends to rise vertically through the bath to the surface and has little or no interaction with the metal at points in the tank relatively distant from the gas-release device. The devices described above do not sufficiently agitate the molten metal so as to mix the gas quickly throughout the entire bath; the gas is only mixed into the molten metal immediately surrounding the gas-release device. Even the known blade-type devices, which break the gas into bubbles and project the bubbles outward into the metal, do not project the gas bubbles very far and therefore, do not adequately mix the gas throughout the molten metal bath.

The inefficiency is also caused by the inability of the devices to form small gas bubbles. As will be appreciated by those skilled in the art, smaller bubbles provide a larger surface area for a given quantity of gas than does large bubbles. The greater the overall surface area, the more of a reaction there is between the gas and the impurities contained within the molten metal.

Additionally, some of the known devices, such as the one disclosed in U.S. Pat. No. 4,634,105 to Withers et al., can jam or clog when solids enter the rotor. Further, many of the prior art devices experience cavitation. The term cavitation as used herein means that the inert gas being introduced into the molten metal becomes trapped in a pocket within the rotor or impeller and does not properly disperse into the molten metal.

Another problem with the prior art devices utilizing a rotating propeller, rotor or other blade-type device is that broken or worn rotor shafts are difficult to remove. The rotor shafts, also called degasser shafts, are usually formed of graphite. The graphite degasser shafts rotate when in use, therefore, they are connected to a drive source, which is generally a steel drive shaft connected to a drive motor. The connection is typically a steel coupling having one side that connects to the steel drive shaft and another side that connects to the graphite degasser shaft. This type of steel coupling usually includes a collar having internal threads that threadingly receives an end of the graphite degasser shaft and retains and aligns this rotor shaft. If the graphite degasser shaft breaks, it typically breaks just below the collar and the end still threaded into the collar must be chiseled out, which is time consuming and expensive.

Another known way to connect a graphite degasser shaft to a steel drive shaft is by connecting it to a threaded projection extending from the drive shaft. In this case, the single connection serves to both transfer torque to the graphite degasser shaft and to create a gas-tight seal with a threaded bore in the degasser shaft. The graphite degasser shafts are usually hollow, having an axial internal bore that functions as a gas-transfer conduit and transfers gas into the molten metal bath. This internal bore may be threaded, in which case a cylindrical projection extending from the drive shaft can be used to couple the graphite degasser shaft to the steel drive shaft. The projection has a threaded outer surface that is received in the threaded bore of the graphite degasser shaft. Although this design allows for relatively easy removal of the rotor shaft if the shaft breaks, the rotor shaft is not supported or aligned by the coupling and the graphite degasser shaft tends to wobble and the graphite threads in the bore wear quickly. As the graphite threads wear, the fit between the bore and the projection loosens. Gas injected into the bore leaks as the fit between the bore and projection loosens. Additionally, as the fit loosens, the rotor shaft becomes more eccentric in its movement, i.e., it wobbles more, and eventually breaks.

Another problem associated with each of the couplings described above is that, as the graphite degasser shafts wear, the gas-tight seal formed at the connection between the rotor shaft and the drive shaft fails and gas leaks occur. The leaks waste gas and are therefore expensive and, if caustic gas such as chlorine is used, the gas interacts with nearby steel causing the steel to oxidize as well as releasing the caustic chlorine gas into the atmosphere. Additionally, as the graphite threads wear and the degasser shaft becomes more eccentric in its movement air is drawn in at the surface of the molten aluminum because of the movement of the degasser shaft. This causes oxidation at the surface of the bath and slag or other impurities are formed.

One attempt to solve the problems associated with coupling a graphite shaft to a steel drive shaft is shown in U.S. Pat. No. 5,203,681 to Cooper entitled "Submersible Molten Metal Pump." This reference discloses a two-piece clamp held in position by a through bolt. Shafts retained by this clamp must include a cross axial bore to allow the bolt to pass through the shaft. This structure would not be used by one skilled in the art to couple a hollow shaft that functions as a gas-transfer conduit because gas would leak from the holes formed as part of the cross axial bore.

SUMMARY OF THE INVENTION

The present invention solves these and other problems by providing a degasser shaft connected to an impeller block. A gas-transfer conduit, which is preferably an elongated cavity or bore extending axially through the degasser shaft, is also provided. The impeller block is comprised of a heat resistant material and has at least one metal-transfer recess formed therein. Preferably the impeller block also has at least one gas inlet in communication with the gas-transfer conduit and at least one gas-release opening formed in each metal-transfer recess, wherein each gas-release opening is in communication with a gas inlet. Gas is transferred through the gas-transfer conduit into a gas inlet in the impeller block where it escapes through the gas-release opening(s). Unlike the blades or vanes disclosed in the prior art, the impeller block displaces a large volume of molten metal as it rotates; in essence, it stirs the molten metal in the tank thereby thoroughly mixing the gas with the molten metal. The prior-art devices simply do not have the surface area to move a large volume of molten metal, as does the present device. Further the present device releases gas directly into the moving molten metal contacting the metal-transfer recess (es). The gas is therefore sheared by the moving molten metal, instead of being mechanically chopped, and simultaneously the metal and gas are pushed or displaced outward into the bath by the rotation of the impeller block. The molten metal containing the gas bubbles is thus dispersed throughout the tank, which increases: 1) the overall dispersion of gas within the bath, 2) the time of the gas/molten metal interface because of the outward thrust of the impeller block and the arcuate travel, rather than vertical, of the gas through the molten metal bath, and 3) the degassing efficiency.

Alternatively, the impeller block may have an opening in the bottom instead of, or in addition to, the gas-release opening(s) in the recess(es). A channel or channels may be formed in the bottom of the impeller block to direct the gas to the recess(es). In this case the gas stream is mechanically sheared by the rotation of the impeller block and mixed into the molten metal contacting the recess(es).

The coupling in accordance with the present device has a coupling flange, a shaft-retention collar and is divided into multiple members and preferably has two members, a first coupling member and a second coupling member. The coupling has a closed position in which it retains the degasser shaft and an open position in which it does not retain the degasser shaft. A retainer is affixed to the first coupling member and preferably surrounds the second coupling member. An adjustment device is connected to the retainer and has a first position in which the coupling is retained in its closed position and a second position in which the coupling is not retained in its closed position and can be moved to its open position.

The inside surface of the shaft-retention collar is preferably smooth, but may be threaded to threadingly receive the degasser shaft. Alternatively, the collar may be tapered to help allow for easy removal of used shafts or the collar may be both tapered and threaded.

OBJECTS OF THE INVENTION

It is an object of the present invention to remove impurities from molten metal.

It is a further object of the present invention to remove dissolved hydrogen from molten aluminum.

It is a further object of the present invention to introduce gas into molten metal.

It is a further object of the present invention to thoroughly mix the molten metal throughout the bath.

It is a further object of the present invention to thoroughly mix the molten metal while simultaneously dispersing gas within the molten metal.

It is a further object of the present invention to provide a device for removing impurities from molten metal wherein the device includes a degasser shaft including a gas-transfer conduit and an impeller block connected to the degasser shaft. The impeller block includes at least one metal-transfer recess for displacing the molten metal.

It is further object of the present invention to provide a device as described above wherein the impeller block has one or more gas inlets that communicate with the gas-transfer conduit and each recess has at least one gas-release opening. Each gas-release opening is communication with at least one of the gas inlets.

It is further object of the present invention to couple the degasser shaft to a device that rotates the degasser shaft.

It is further object of the present invention to provide a coupling that can be easily uncoupled from the degasser shaft.

It is a further object of the invention to provide a coupling that supports and aligns the degasser shaft.

It is a further object of the present invention to provide a coupling that positively seals the degasser shaft and that does not develop gas leaks.

It is further object of the present invention to provide a coupling comprising a first coupling member and a second coupling member, the members being juxtaposed and the coupling having a closed position wherein it retains the degasser shaft and an open position wherein it does not retain the degasser shaft.

It is a further object of the present invention to provide a coupling as described above that includes a retainer that is connected to the first coupling member. The retainer includes an adjustment device that has a first position wherein the coupling is retained in its closed position and a second position wherein the coupling is not retained in the closed position and can be moved to the open position.

It is a further object of the present invention to provide a coupling as described above wherein the retainer is generally U-shaped and surrounds the second coupling member.

It is a further object of the present invention to provide a coupling as described above wherein the adjustment device is a bolt threadingly received in the retainer.

It is a further object of the present invention to provide a degasser shaft that can be positively sealed and that remains sealed as it is rotated during use.

These and other objects of the invention will become known to those skilled in the art upon a reading of the following disclosure and the appended claims.

BRIEF DESCRIPTION OF THE DRAWINGS

FIG. 9A is a cross sectional top view of the present invention submersed in a molten metal bath illustrating gas being dispersed into the molten metal.

FIG. 9B is a cross sectional top view of a prior art device submersed in a molten metal bath illustrating gas being dispersed into the molten metal.

DETAILED DESCRIPTION OF A PREFERRED EMBODIMENT

Figure 1:
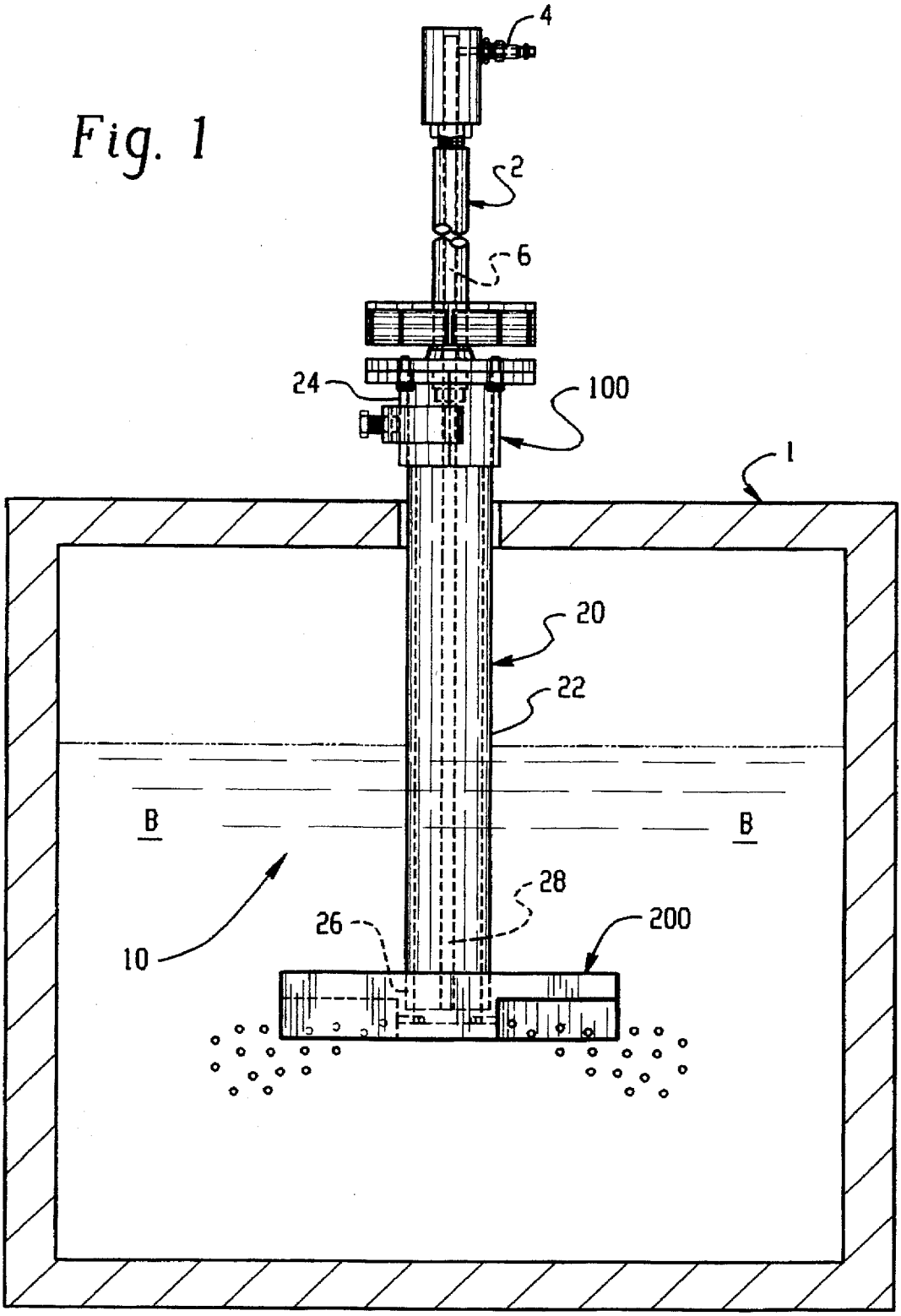
FIG. 1 is a side view showing the present invention connected to a drive shaft and inserted into a molten metal bath.

Turning now to the drawings where the purpose is for describing a preferred embodiment of the invention and not for limiting same, FIG. 1 shows a cross-sectional view of a tank 1 containing a molten-metal bath B and a rotary degasser 10 in accordance with the present invention. Rotary degasser 10 includes a degasser shaft 20, a coupling 100 and an impeller block 200. Rotary degasser 10 is coupled to a drive shaft 2, which is connected to a drive motor (not shown).

Figure 2:
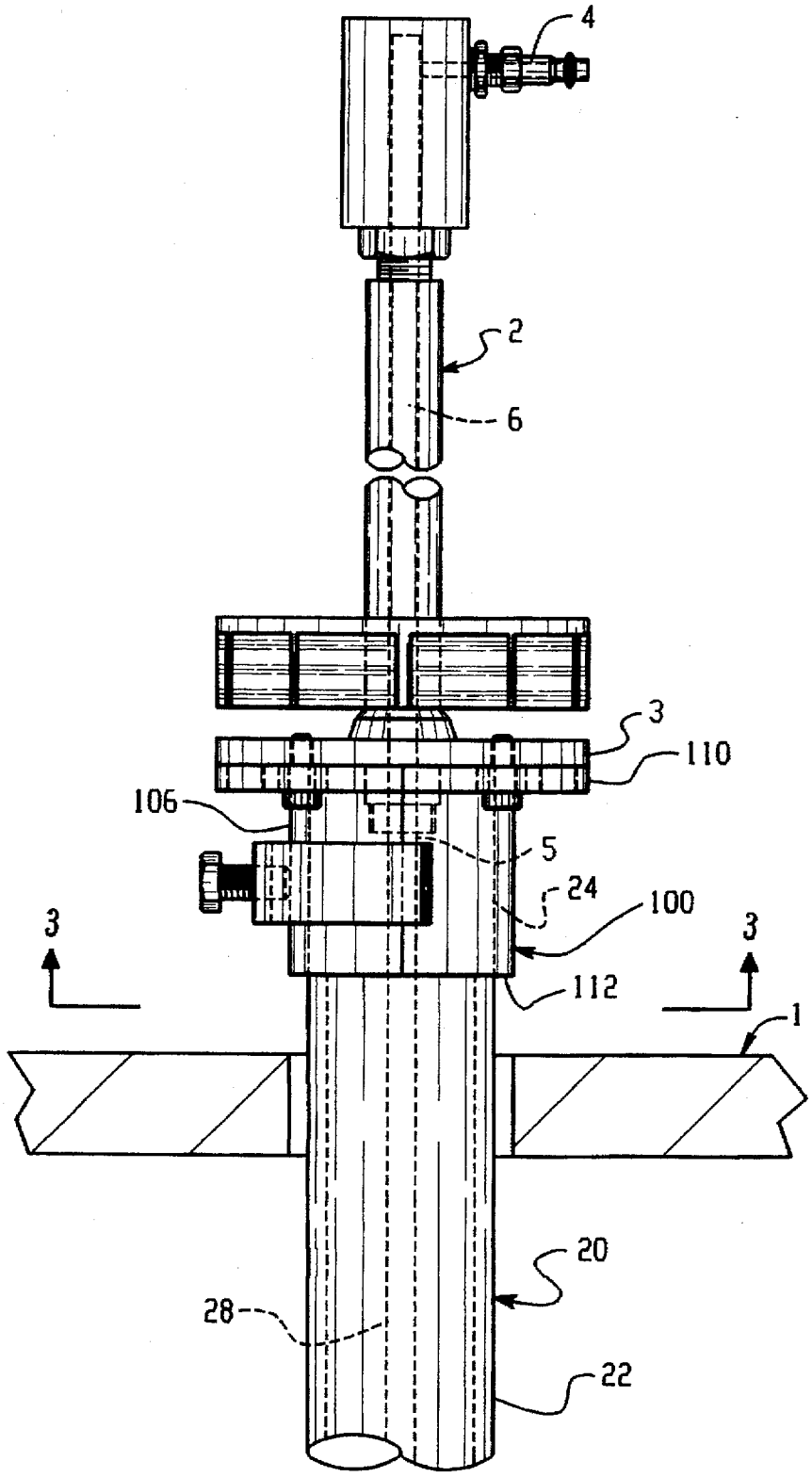
FIG. 2 is a partial, enlarged view of the device shown in FIG. 1 showing the degasser shaft coupled to the drive shaft.

Turning now to FIGS. 1 and 2, degasser shaft 20 is generally cylindrical and is preferably formed of graphite impregnated with an oxidation-resistant solution, although other materials may be used. Degasser shaft 20 has a cylindrical outer surface 22, a first end 24 and a second end 26. Outer surface 22 may be threaded, or tapered, or threaded and tapered at end 24, although in the embodiment shown end 24 is smooth. Surface 22 is preferably threaded at end 26. Shaft 20 is preferably hollow and includes a cylindrical passageway 28 extending therethrough.

Figure 3:
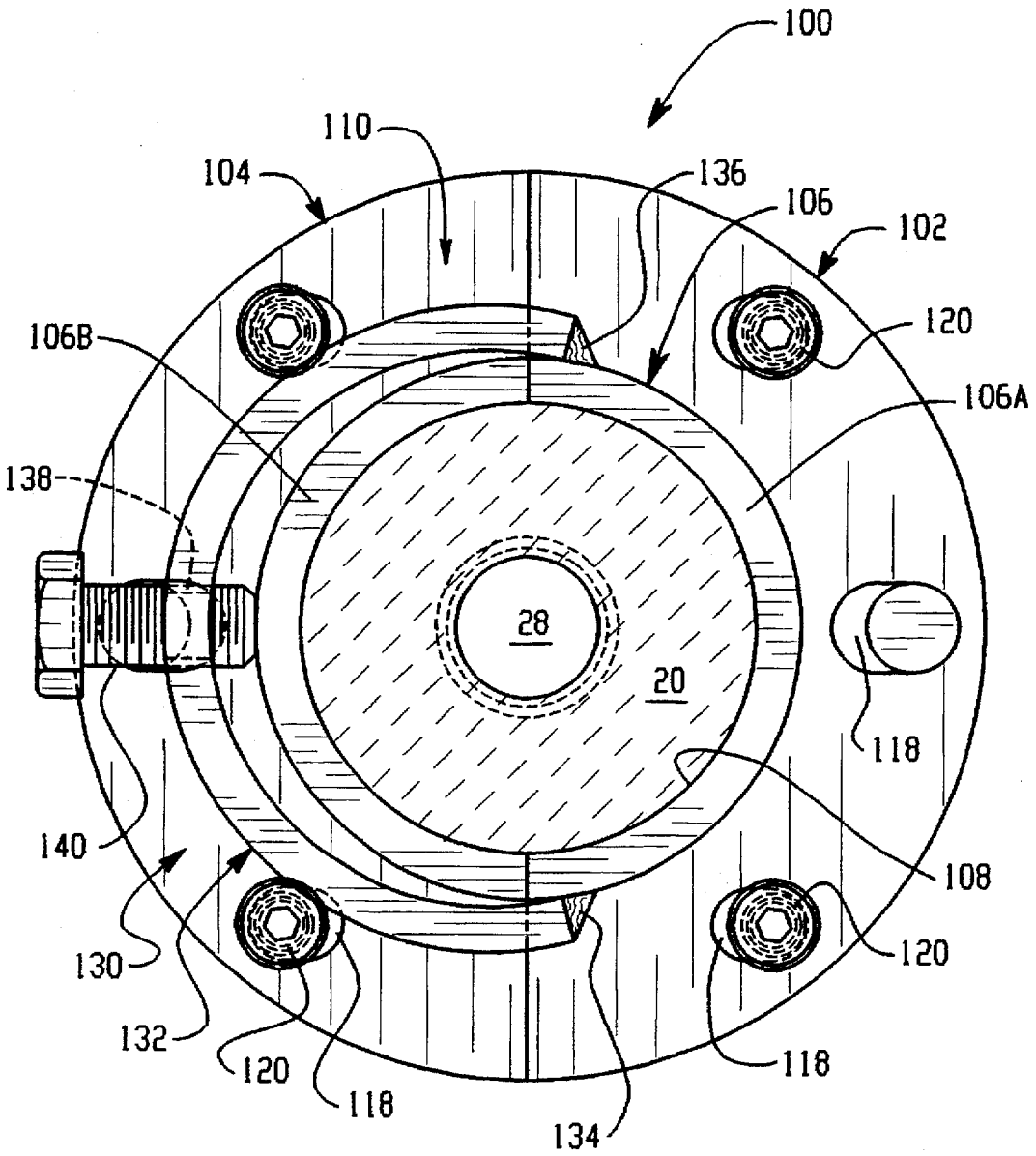
FIG. 3 is an enlarged, sectional view taken along lines 3—3 showing a coupling in accordance with the present invention, the coupling being in its closed position.
Figure 4:
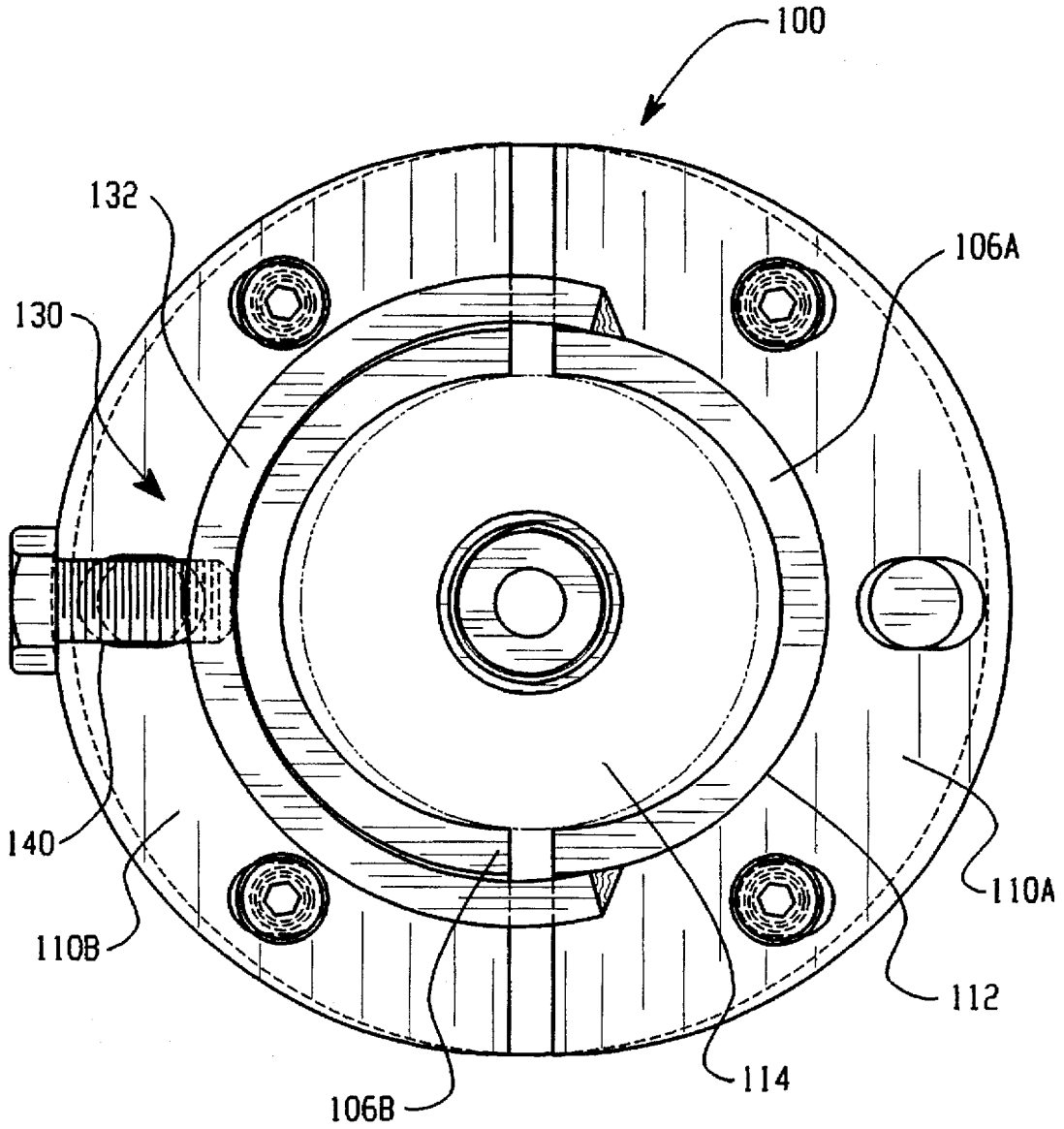
FIG. 4 is an enlarged, top view of a coupling in accordance with the present invention, the coupling being in its open position.
Figure 5:
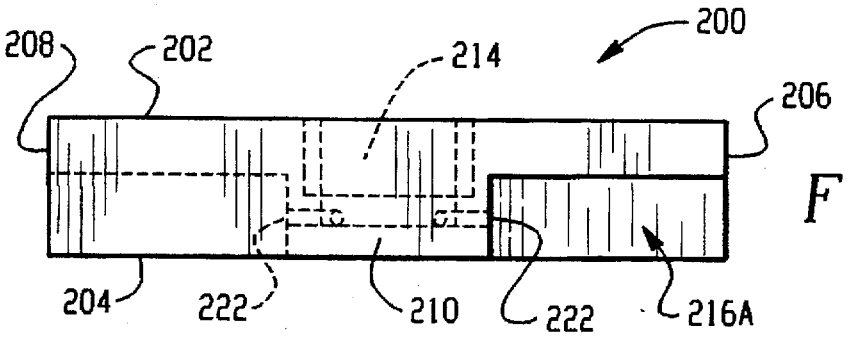
FIG. 5 is a side view of an impeller block in accordance with the present invention.
Figure 6:
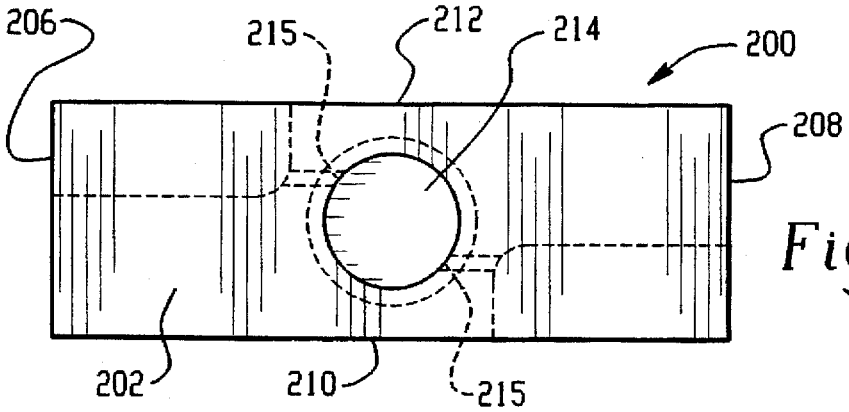
FIG. 6 is a top view of the impeller block shown in FIG. 5.
Figure 7:
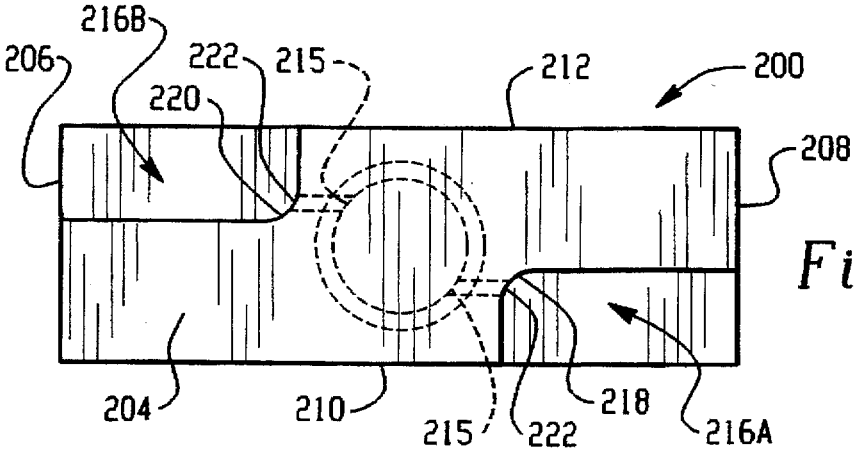
FIG. 7 is a bottom view of the impeller block shown in FIG. 5.
Figure 8:
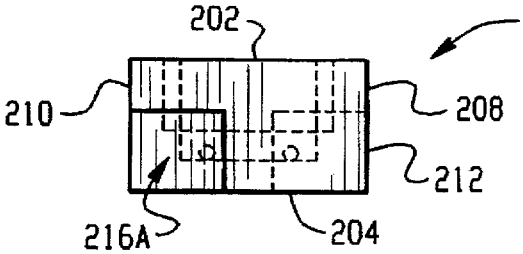
FIG. 8 is an end view of the impeller block shown in FIG. 5.
Figure 10:
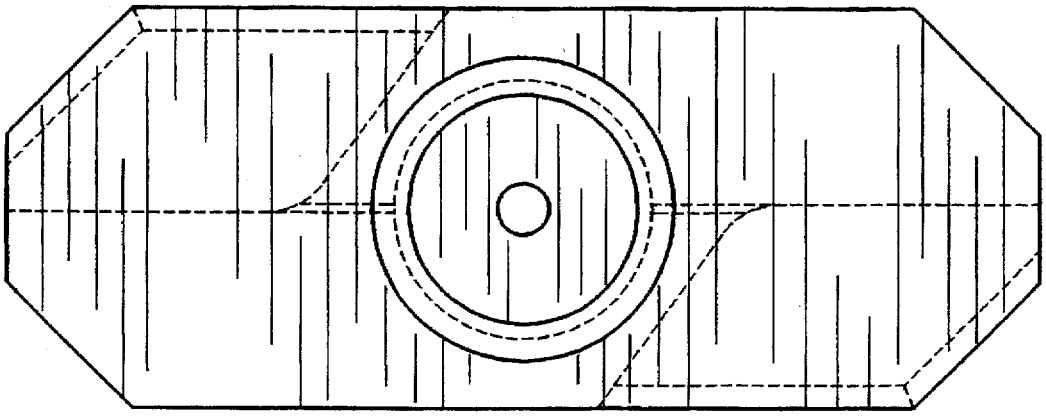
FIG. 10 is a top view of an alternative embodiment of the present invention showing an impeller block having a recess with an angle greater than 90°.
Figure 11:
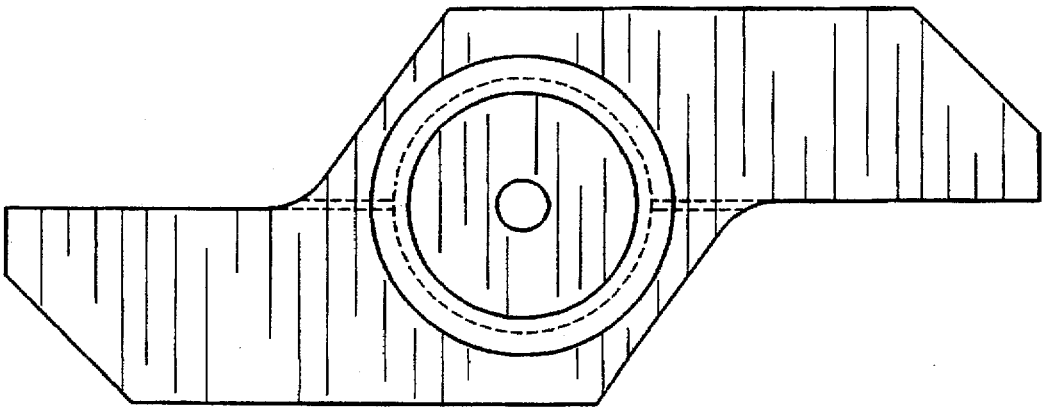
FIG. 11 is a top view of an alternative embodiment of the present invention showing a top view of an impeller block having recesses with an angle greater than 90° where the recesses extend through the top of the block.

Turning now to FIGS. 3 and 4, coupling 100 is shown in its closed and open position respectively. Coupling 100 preferably is comprised of two coupling members, members 102 and 104, but can be comprised of more than two members. Shown in its closed position in FIG. 3, coupling 100 comprises an annular flange 110 and a generally cylindrical collar 106. Collar 106 extends outward perpendicularly from flange 110 and has an open end 112. Preferably, flange 110 and collar 106 are integrally formed from steel, although other suitable materials can be used, and collar 106 may be a separate member attached to flange 110. In the preferred embodiment collar 106 extends outward approximately 2¼" from flange 110 and has an inside surface 108 that defines an opening 114. Inside surface 108 contacts surface 22 and retains degasser shaft 20 when coupling 100 is in its closed position, as will be described in greater detail below. Inner surface 108 is preferably smooth and cylindrical, however, it can also be threaded so as to threadingly receive end 24 of degasser shaft 20, in which case surface 22 will be threaded at end 24. Inner surface 108 may be tapered outward so that when coupling 100 is in its closed position the diameter of surface 108 is greater at end 112 than it is at a position near flange 110.

Collar 106 is comprised of two sections, section 106A, which is part of coupling member 102, and section 106B, which is part of coupling member 104. Flange 110 also consists of two sections, section 110A which is part of coupling member 102, and section 110B, which is part of coupling member 104.

Flange 110 has apertures 118 formed therein. Apertures 118 are slotted to allow for movement of sections 102 and 104. There are preferably six apertures 118, three in flange section 110A and three in section 110B. When coupling 100 is in its closed position, as shown in FIG. 3, apertures 118 are preferably equally radially spaced about flange 110. Bolts 120 are positioned in four of apertures 118 and are threadingly received in a coupler plate 3, which is bolted or welded to drive shaft 2. The remaining apertures 118 receive a shear pins 122. Pins 122 are connected to plate 3 and function to properly position coupling 100 against coupler plate 3 and to absorb some of the load or torque being transfered from plate 3 so that bolts 118 do not bend.

Retention device 130 comprises a retainer 132 and an adjustment device 140. In the embodiment shown retainer 132 is a generally U-shaped steel ring having ends 134 and 136. Ends 134 and 136 are connected to collar section 106A of coupling member 102, preferably by welding although other suitable means of attachment could be used or retainer 132 could integrally formed with section 106A. Alternatively, retainer 132 could be connected to flange portion 110A. Further, retainer 132 need not be U-shaped, it could be of any shape, and it need not surround collar section 106B; it only needs to be of a size and shape necessary to retain coupling 100 in a closed position while device 10 is in use and degasser shaft 20 is rotating.

An aperture 138 is formed near the center of retainer 132 and is preferably circular and has a threaded surface. An adjustment device 140 is preferably a bolt threadingly received in aperture 138, although other adjustment devices may be used to close retention device 130 about degasser shaft 20. Adjustment device 140 has a first position, shown in FIG. 3, wherein coupling 100 is retained in the closed position, and a second position, shown in FIG. 4, wherein coupling 100 is not retained in the closed position and can be moved to the open position.

If coupling 100 were comprised of more than two coupling members, retainer 132 would be fastened to one or more of the coupling members and one or more adjustment devices 140 would move the remaining coupling members from the open to the closed position.

In an alternate embodiment of coupling 100 not shown in the drawings, retainer 132 comprises outward extending flanges formed on collar sections 106A and 106B. The outward extending flanges could be bolted together or otherwise joined to retain coupling 100 in the closed position. In that case, adjustment device 140 would be the bolts or other fastening members used to join the flanges. Another embodiment of coupling 100 not shown comprises a retention device 130 which is generally an annular metal ring or a metal strap not connected to coupling 100. In that case, adjustment device 140 is a bolt, screw or other device that tightens the ring or strap around collar sections 106A and 106B to retain coupling 100 in its closed position. In each of these embodiments coupling 100 may have more than two collar sections.

Turning now to FIGS. 5–8 an impeller block in accordance with the present invention is shown. Impeller block 200 is generally rectangular in shape and is preferably comprised of graphite impregnated with an oxidation resistant solution, although other materials may be used. Block 200 has a top surface 202, a bottom surface 204, a first end 206, a second end 208, a first side 210 and a second side 212. In the preferred embodiment, block 200 is ten inches long, as measured along either side 210 or 212, 3½ inches wide, as measured along either end, 206 and 208 and has a depth of two inches, as measured from top surface 202 to bottom surface 204. These dimensions are preferred, however, an impeller block having a length as small as 6 inches and a depth of 1½ inches has been found to sufficiently stir the molten metal bath B.

Top surface 202 includes a bore 214 formed therein. Bore 204 is preferably cylindrical, threaded, 2½" in diameter and 1½" in depth. Gas inlets 215 are formed in bore 204 and form a preferably cylindrical passageway through block 200. Gas inlets 215 are preferably 1/16" to 3/8" in diameter.

Metal-transfer recesses 216A and 216B are formed in block 200. Recess 216A is formed between end 208 and side 210 and recess 216B is formed between end 206 and side 212. Each recess 216A and 216B has a generally rectangular opening preferably 2½" long, 1½" wide and 1¼" deep although other sized recesses could be used. Recesses as small as 10% of the length, 25% of the width and 25% of the depth of the block can, however, be used. The exact size of the recesses will depend upon the size of the impeller block and the size of tank 1, because the size of tank 1 dictates the volume of molten metal to be mixed by rotory degasser 10. Inside corners 218 and 220 are radiused so that metal and gas do not clog, i.e., so that there is no cavitation in, the corners. Although the above dimensions are preferred, other dimensions could be used.

A gas release opening 222 is formed at each corner, 218, 220, of metal-transfer recesses 216A and 216B. Openings 222 are preferably cylindrical and 1/16" to 3/8" in diameter although other shapes and sizes could be used. Furthermore, openings 222 need not be formed at the corners 218, 220 of recesses 216A and 216B, this merely being a preferred embodiment. Openings 222 may be formed at any location within recesses 216A, 216B. Additionally, openings 222 may contain a porous plug of ceramic or other suitable material through which the gas would effuse and this arrangement would also be referred to as an opening. It is also possible that more than one gas release opening 222 be formed in each respective recess, 216A and 216B.

In another embodiment not shown in the drawings, block 200 has one or more opening(s) formed in bottom surface 204 that communicates with opening 214. This embodiment may include one or more channels formed in bottom surface 204 of block 200 wherein the channel(s) communicate with recesses 216A and 216B.

In either embodiment of block 200 discussed above, block 200 may alternatively only contain one metal-transfer recess or block 200 may have more than two ends and each end could then contain a metal-transfer recess, in which case block 200 would have more than two recesses.

To assemble device 10, end 26 of degasser shaft 20 is preferably threadingly received in opening 214 of block 200 although other means of attachment, such as cement, may be used. End 24 of degasser shaft 20 is placed between collar sections 106A and 106B when adjustment device 140 is in its second position and coupling 100 is in its open position. Passage 28 is preferably threaded at end 26 and is threaded onto projection 5 so as to create an gas-tight seal. Adjustment device 140 is then moved from its second to its first position thereby moving coupling 100 from its open to its closed position, wherein coupling 100 retains end 24 of degasser shaft 20 and aligns degasser shaft 20, as shown in FIG. 3. Preferably inside surface 108 of collar 106 is pressure fit against surface 22 at end 24 when coupling 100 is in its closed position. Surface 108 and surface 22 at end 24 may also be threaded so that end 24 is threadingly received in collar 106, in which case coupling 100 would first be moved to its closed position and then end 24 would be threaded into opening 114.

In operation, drive shaft 2 drives coupling 100 which causes degasser shaft 20 and impeller 200 to rotate in molten metal bath B. Simultaneously, gas is introduced from a gas source (not shown) and travels through passage 6 in drive shaft 2, through projection 5 and into and through passage 28. The gas enters opening 214 and gas inlet(s) 215 and escapes through gas-release opening(s) 222. The gas is sheared by the stream of molten metal and is dispersed within the molten metal interfacing with recesses 216A and 216B and the molten metal with the gas dispersed therein is pushed outward into molten metal bath B thus dispersing the gas throughout the bath.

If block 200 having one or more openings in bottom surface 204 is used, the assembly and operation of device 10 is the same as described above except that the gas travels through passageway 28 and escapes through an opening in the bottom of degasser shaft 20 and exits out of the openings in surface 204. Alternatively, degasser shaft 20 may extend through the opening(s) in surface 204 and gas is released into the molten metal bath through the opening in the bottom of degasser shaft 20 and/or the opening(s) in surface 204.

The gas exiting the opening in the bottom of the degasser shaft 20 is released into molten metal bath B, beneath impeller block 200. Block 200 is rotating and recesses 216A and 216B physically cut or shear the gas rising from beneath block 200 thus forming small bubbles that are dispersed into the molten metal in contact with the recesses 216A and 216B. The molten metal containing the dispersed gas is then physically displaced throughout bath B thus dispersing the gas throughout the bath.

The purpose of the above description is to set forth a preferred embodiment of the invention, the present invention, however, is not limited to this particular embodiment but is instead set forth in the following claims and the legal equivalents thereof.

What is claimed is:

1. A device for introducing gas into molten metal, said device including:

a) a degasser shaft, said shaft comprising a gas-transfer conduit;

b) an impeller block connected to said degasser shaft, said impeller block having a gas inlet communicating with said gas-transfer conduit and at least one metal-transfer recess formed therein;

c) at least one gas-release opening formed in each of said recesses; and d) a coupling connected to said degasser shaft;

whereby said device is positioned in a molten metal bath and said degasser shaft is connected to a drive source by said coupling; the drive source turns the degasser shaft and the impeller block, the impeller block thereby displacing the molten metal substantially entirely radially and simultaneously, gas is introduced into said conduit whereby it passes into the gas inlet and out of the gas-release opening(s) where it is sheared by the molten metal being displaced by the recess.

2. A device as defined in claim 1 wherein said impeller block is comprised of graphite.

3. A device as defined in claim 1 wherein said impeller block has two ends and a metal-transfer recess formed at each end.

4. A device as defined in claim 1 wherein said impeller block is threadingly received onto said degasser shaft.

5. A device as defined in claim 2 wherein said block is generally rectangular.

6. An impeller block for dispersing gas into molten metal, said block formed of heat resistant material, said block comprising at least one gas inlet, at least one metal-transfer recess and at least one gas-transfer opening formed in said recess, and in communication with said gas inlet, said block connectable to a degasser shaft whereby said shaft turns said block thereby substantially entirely radially displacing the molten metal and gas is introduced into said gas inlet and passes out of said gas-transfer opening where it is sheared by the molten metal being displaced by the recess.

7. An impeller block as described in claim 6 which further includes at least one gas-inlet and at least one gas-release opening in each metal-transfer recess, said at least one gas-release opening being in communication with said at least one gas inlet.

8. An impeller block for dispersing gas into molten metal, said block formed of heat resistant material, said block comprising at least one metal-transfer recess, as defined in claim 6 which further includes a bottom surface and an opening in said bottom surface, whereby said block is connectable to a degasser shaft that turns said block thereby substantially entirely radially displacing the molten metal and gas or flux is released through said opening where it travels into said recess and is sheared by the molten metal entering said recess.

9. An impeller block as defined in claim 8 which further includes a one or more channels in said bottom, said channels directing the gas released through said opening.

10. A device as defined in claim 6 wherein said at least one metal-transfer recess is at least 10% of the length of said block.

11. A device as defined in claim 6 wherein said at least one metal-transfer recess is at least 25% as wide as said block.

12. A device as defined in claim 11 wherein said at least one metal-transfer recess is at least 25% the depth of said block.

13. A device as defined in claim 6 wherein said block is at least 6" in length.

14. A coupling for connecting a hollow degasser shaft to a drive device, said coupling comprising an annular flange with an inner surface defining an opening and a generally cylindrical collar connected to, and extending perpendicularly from said annular flange;

said collar comprising at least a first coupling member and a second coupling member and said annular flange comprising at least a first flange section connected to the first coupling member, and a second flange section connected to the second member;

said coupling device further comprising a retainer and an adjustment device, said retainer being connected to said retainer and having a first position wherein said coupling is in a closed position, and is able to retain the hollow degasser shaft within said opening, and said adjustment device having a second position wherein said coupling is not retained in a closed position and can be moved to an open position, where the hollow degasser shaft is not retained within said opening.

15. A coupling as defined in claim 14 wherein said adjustment device is in contact with said second coupling member when said adjustment device is in said second position.

16. A coupling as defined in claim 14 wherein said retainer surrounds said second coupling member.

17. A coupling as defined in claim 14 wherein said adjustment device is a bolt threadingly received in said retainer.

18. A device for introducing gas into molten metal, said device including:

a) a degasser shaft, said degasser shaft comprising a gas-transfer conduit;

b) an impeller block connected to said degasser shaft, said impeller block having a gas inlet communicating with said gas-transfer conduit and at least one metal-transfer recess formed therein; and c) at least one gas-release opening formed in each of said recesses;

whereby said device is positioned in a molten metal bath and said degasser shaft is connected to a drive source by said coupling; the motor turns the degasser shaft and the impeller block, the impeller block thereby displacing the molten metal substantially entirely radially and simultaneously, gas is introduced into said conduit whereby it passes into the gas inlet and out of the gas-release opening into the molten metal being displaced by the recess.

19. In combination, a degasser shaft connected to a coupling for connecting a hollow degasser shaft to a drive device, said coupling comprising an annular flange with an inner surface defining an opening, and a generally cylindrical collar connected to, and extending perpendicularly from said annular flange;

said collar comprising at least a first coupling member and a second coupling member and said annular flange comprising at least a first flange section connected to the first coupling member, and a second flange section connected to the second coupling member;

said coupling device further comprising a retainer and an adjustment device, said retainer being connected to said first coupling member, said adjustment device being connected to said retainer and having a first position wherein said coupling is in a closed position, and is able to retain the hollow degasser shaft within said opening, and said adjustment device having a second position wherein it does not contact said second coupling member and said coupling can be moved to an open position where the hollow degasser shaft is not retained within said opening.

* * * * *